United States Patent [19]

Andreoli et al.

[11] 4,018,168

[45] Apr. 19, 1977

[54] INCINERATOR FEED

[75] Inventors: Bruno Andreoli, Mannedorf; Trauterose Fiebig, Zurich; Gustav Maurer, Volketswil, all of Switzerland

[73] Assignee: Von Roll AG, Switzerland

[22] Filed: Mar. 10, 1976

[21] Appl. No.: 665,722

[30] Foreign Application Priority Data

Mar. 17, 1975 Switzerland ..... 3386/75

[52] U.S. Cl. ..... 110/38; 126/174

[51] Int. Cl.[2] ..... F23B 1/18

[58] Field of Search ..... 110/38, 40 C, 33; 126/174; 266/77, 78, 79

[56] References Cited

UNITED STATES PATENTS 1,832,888 11/1931 Zinkernagel ..... 110/40 C 3,212,465 10/1965 Cates, Jr. et al. ..... 110/38

FOREIGN PATENTS OR APPLICATIONS 634,650 3/1950 United Kingdom ..... 110/40 C

*Primary Examiner*—Kenneth W. Sprague

*Attorney, Agent, or Firm*—Weingarten, Maxham & Schurgin

[57] ABSTRACT

A furnace feed grate of an incinerator comprises transverse rows of grate blocks, the blocks of alternate rows being movable to feed refuse along the grate. Clamping devices at the underside of the grate resiliently urge together the blocks of the respective rows. At the lateral edges of the grate, sealing plates are resiliently urged into sealing contact with the ends of the rows independently of the action of the clamping devices. The grate, the clamping devices and the sealing plates can be removed from the incinerator as a single unit.

20 Claims, 7 Drawing Figures

R1,R2
R2
B1
S31/32
S 31/32
I
I

INCINERATOR FEED

BACKGROUND OF THE INVENTION

1. Field of the Invention

This invention relates to furnace grates having transverse rows of grate elements. It is relevant to furnace feed grates for incinerators, for example refuse incinerators.

2. Description of the Prior Art

In a known incinerator feed grate having transverse rows of grate blocks (see Swiss Patent No. 457685), a clamping device comprises two shell members capable of sliding telescopically, to a partial extent, in one another, the members being pressed away from one another in the transverse direction of the grate by a compression spring arranged horizontally between the two shell members, thus forming in the region of a side wall of a combustion chamber an elastically compressible grate boundary wall, the external shell member being incorporated in the refractory brickwork of the combustion chamber side wall and serving as a stationary abutment for taking up the clamping pressure, whereas the internal mobile shell member presses under the action of the compression spring on the outermost block of a transverse row of grate blocks and as a result ensures that the grate blocks situated adjacent one another within the row are pressed elastically against one another so that adjacent grate blocks in the row come to be situated against one another without any gaps between them, at all working temperatures, eliminating the thermal expansion clearance which is provided at the grate assembly stage. This is intended to ensure that, when starting the firing system from cold, and also in the hot state, there will be no fuel losses due to material falling through the grate, during operation slag pieces and foreign substances contained in the fuel cannot get in between the grate blocks, and also that under-grate air will not flow out undesirably between these blocks. A further object is to obviate the undesirable formation of marginal fires in the region of the side walls of the combustion chamber. For the same purpose, in this known feed grate, which is intended for large firing systems, two-part elastically compressible partition walls, each similar in construction to the boundary wall described above, are provided at intervals between individual grate paths, for example two such partition walls between three grate paths. However, in this known grate arrangement the mobile outermost grate blocks and the adjoining portions of the side wall of the combustion chamber are subjected to a considerable rate of wear which is caused by the relatively high clamping pressure of each block clamping device, which is used not only to press the grate blocks within the transverse row elastically against one another but also to press the outermost grate blocks of the transverse row at the same time against the internal shell member of a grate boundary wall. In addition, in this known grate the elastically compressible boundary walls are subjected to the heat of the fire and also to the action of dust and ashes, since they are situated directly below the fire bed. Also it is not possible to lift off and put down the grate together with the clamping device.

There are also known (see East German Patent No. 105048) closure and wearing plates for the ends of transverse grate block rows of mechanical inclined grate firing systems which plates are mounted to be pivotable, in the combustion chamber side walls on an axis of rotation situated outside their mass centre of gravity axis, on a horizontal pin, so that they swing automatically under the effect of their own weight on to the adjacent outermost mobile grate blocks and lean against them. When wear occurs, these lateral wearing and closure plates are intended to swing-in correspondingly so that at all times there will be substantially no gap, and thus in this region combustion air is prevented from passing through from a chamber below the grate upwards into the combustion chamber. But the wear at the plates and the grate blocks is in the first instance relatively considerable since their mutual bearing contact surfaces immediately after the grate is assembled can only be of very limited size and increase in size only during relatively long operation and grinding into one another. Apart from this, the effective sealing pressure on the lateral grate block surfaces continually increases as the pivoting movement of the plates continues, so that the sealing conditions at the plates also continually change in an undesirable manner. But above all, since the outermost grate block is fixed against lateral displacement by a securing means, the problem of gaps between the respective adjacent grate blocks in each of the transverse rows of blocks remains unsolved. A grate which is provided with these known closure and wearing plates also cannot be simply installed or removed along with these plates.

SUMMARY OF THE INVENTION

The present invention provides in combination, a furnace grate comprising transverse rows of grate elements whereof the elements of each row are arranged side-by-side with one another; clamping means associated with each of said rows and arranged to urge elements of the row towards one another to press their sides into contact with one another; sealing means at the ends of the rows for sealing against said ends of the rows; and biassing means arranged to urge said sealing means into sealing contact with said ends of the rows with urging force independent of the clamping force provided by said clamping means. cBRIEF DESCRIPTION OF THE DRAWINGS In order that the invention may be clearly understood and readily carried into effect, reference will now be made, by way of example, to the accompanying drawings, in which:

DESCRIPTION OF THE PREFERRED EMBODIMENT

Figure 1:
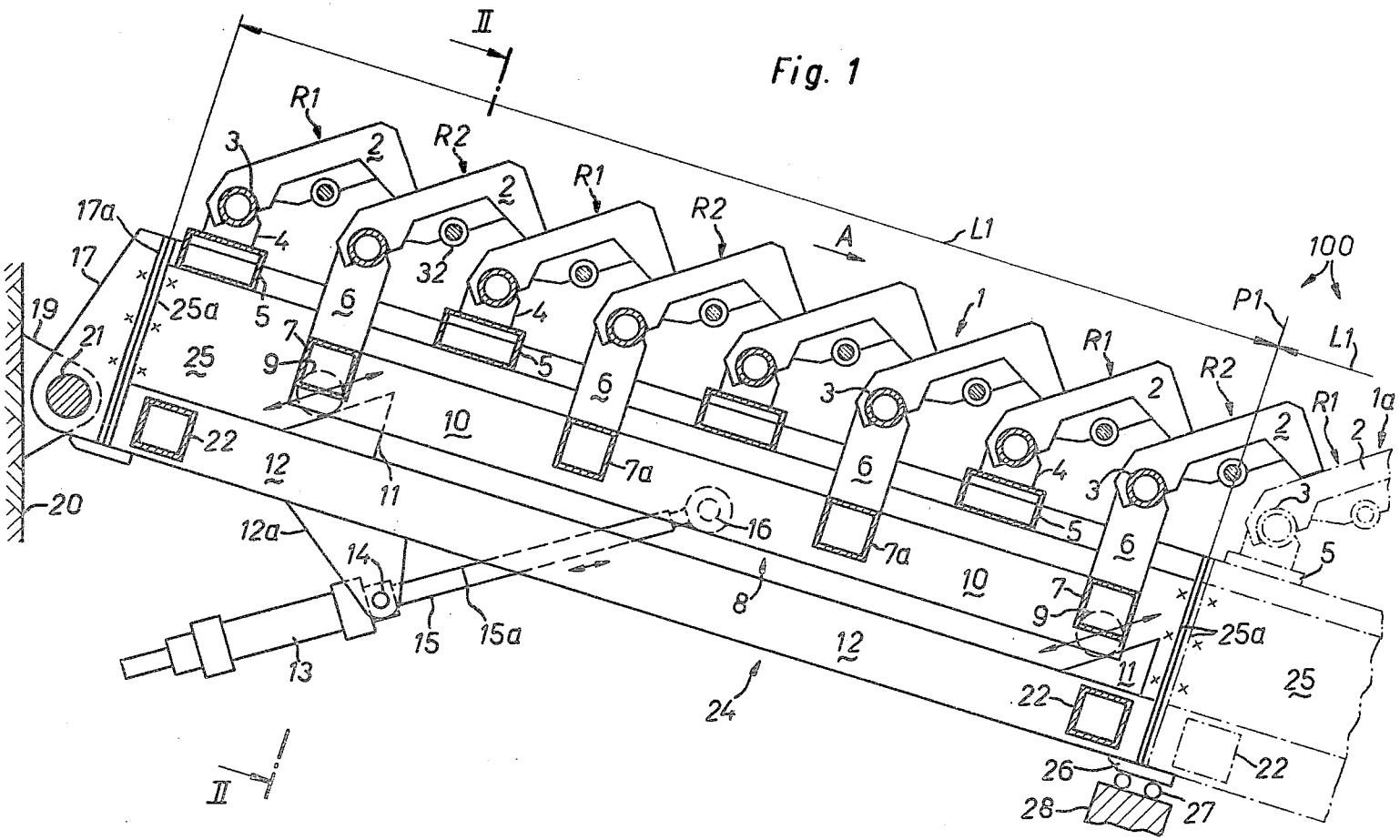
FIG. 1 shows a grate of a mechanical feed grate apparatus of a refuse incinerator, in a longitudinal section taken on the line I-I of FIG. 2.

In FIG. 1, a grate, designated with the general reference numeral 1, of an inclined mechanical feed grate apparatus of a refuse incinerator, which grate apparatus is given the reference numeral 100, comprises a plurality of rows R of grate elements in the form of grate blocks 2 which rows extend transversely of the grate. Transverse rows R1, with stationary grate blocks 2 situated side-by-side, alternate with transverse rows R2 with grate blocks 2 which are also situated side-by-side but which are capable of moving to and fro. The mobile and stationary grate blocks 2 are identical in construction to one another and are mounted to be pivotable on horizontally disposed continuous block holding tubes 3. The block holding tubes 3 for the stationary grate blocks 2 of the transverse block rows R1 are supported by bearing brackets 4 which are secured on cantilever beams 5 of a stationary supporting structure of the grate element 1, the beams 5 being arranged transversely of the grate 1, whereas the block holding tubes 3 of the mobile grate blocks 2 of the rows R2 rest on bearing brackets 6 which themselves are secured on through transverse beams 7 and cantilever beams 7*a* of a driving carriage 8 capable of moving in the feed direction A of the grate. The driving carriage 8 used for moving the mobile block rows R2 is provided with running rollers 9 which are mounted to be rotatable in two parallel longitudinal beams 10 of the carriage 8 and run on inclined running surfaces of track ramps 11 secured on two parallel lower longitudinal beams 12 of the stationary supporting structure of the grate 1 (see also FIG. 2). The chassis of the driving carriage 8 thus comprises a running gear frame which includes the two parallel longitudinal beams 10, the transverse beams 7 extending at right angles to these, and the cantilever beams 7*a*. Hydraulic or pneumatic working cylinders 13 are pivotably suspended in each case on a downwardly projecting bearing bracket 12*a* of the two lower longitudinal beams 12 by means of pivot pins 14, and are used basically for the driving of the mobile transverse block rows R2. For this purpose working piston rods 15 of the two driving cylinders 13, which for easy assembly of the cylinders 13 consist of two rod parts and are connected to one another at a region 15*a* by a coupling element not shown in FIG. 1, are connected pivotably to the two longitudinal beams 10 of the carriage 8 by a pivot pin 16 in each case. In this way the piston rods 15 of the driving cylinders 13, moving to and fro, give the carriage 8 an obliquely upwardly and downwardly directed reciprocating movement such as is indicated in FIG. 1 by respective double arrows at the running rollers 9. The pivot pin connections 14 and 16 ensure the necessary non-jamming sequence of movements for the driving carriage 8 and the working cylinders 13, even if the inclined movement direction of the driving carriage 8, which is moved to and fro in the inclined position, that is to say is pushed forwards and backwards linearly parallel to itself, is not always the same but differs to a more or less considerable extent from grate to grate.

Two holding brackets 17 are flange-connected to the front end of the grate 1 and mounted to be pivotable on bearing brackets 19 of the incinerator framework, designated as 20 in FIG. 1, by means of pivots 21. The two lower longitudinal beams 12 of the stationary supporting structure of the grate 1 are spaced from one another at their ends by transverse beams 22 and connected to form a stationary rectangular supporting frame 24. Stationary upper longitudinal deep beams 25 are connected to the two lower longitudinal beams 12, in each case there being provided a securing flange 25*a* which is common to the two associated beams 12 and 25, bracket flanges 17*a* of the holding brackets 17 being secured to the securing flanges 25*a*. The stationary supporting frame 24, together with the driving cylinders 13, the carriage 8 and all the transverse block rows R1 and R2, that is to say the complete grate 1, is thus mounted to be pivotable about the pivot pin 21.

On the rear end of the lower longitudinal beams 12 there is arranged in each case a coupling element 26 which is provided with running rollers 27 running on a sloping running surface of a stationary support 28. The grate 1 is thus suspended at the front by means of the pivots 21 in a pivotable manner on the incinerator frame work 20 and at the rear bears by means of the running rollers 27 of the coupling element 26, forming a supporting carriage, on the inclined running surface of the support 28. Instead of the running rollers 27, slides could be provided on the grate 1.

The grate 1, which has a length L1, is followed directly in the feed direction A by a second grate 1*a* which is constructed in exactly the same way as the grate 1 and therefore is only indicated with dot-dash lines in FIG. 1. The two successive grates 1 and 1*a* are connected to one another at their end flanges 25*a*, the front end of the second grate 1*a* also bearing on the supporting carriage 26/27 of the first grate 1.

The mobile grate blocks 2 of the last (that is to say fourth) mobile transverse block row R2 of the first grate 1 bear on the stationary grate blocks 2 of the first stationary transverse block row R1 of the second grate 1*a*, so that the alternate sequence of stationary transverse block rows R1 and mobile transverse block rows R2 of the grate 1 is continued uniformly beyond the plane of division, designated as P1 in FIG. 1, into the second grate 1*a*. The two grates 1 and 1*a* can be of completely identical construction to one another; it is simply necessary in regard to the first grate 1, forming the front part of the grate apparatus, to secure to its two front flanges 25*a* the brackets 17.

In the last grate of the inclined grate apparatus 100, for example the grate 1*a* of FIG. 1, the last transverse row consists of stationary grate blocks which rest on a stationary transverse edge (not shown), whereas both the second-last and also the third-last transverse row comprise mobile grate blocks, so that the throwing of burned-out material off the end of the grate apparatus into the cinder shaft (not shown) of the incinerator is assisted. An end piece arranged at the end flange 25*a* of the last grate (for example 1*a* in FIG. 1) at the transition between the grate end and the cinder shaft is used as a dumping edge for the grate, and is thus independent of the incinerator framework and cinder shaft.

Figures 2, 3, 4, 5:
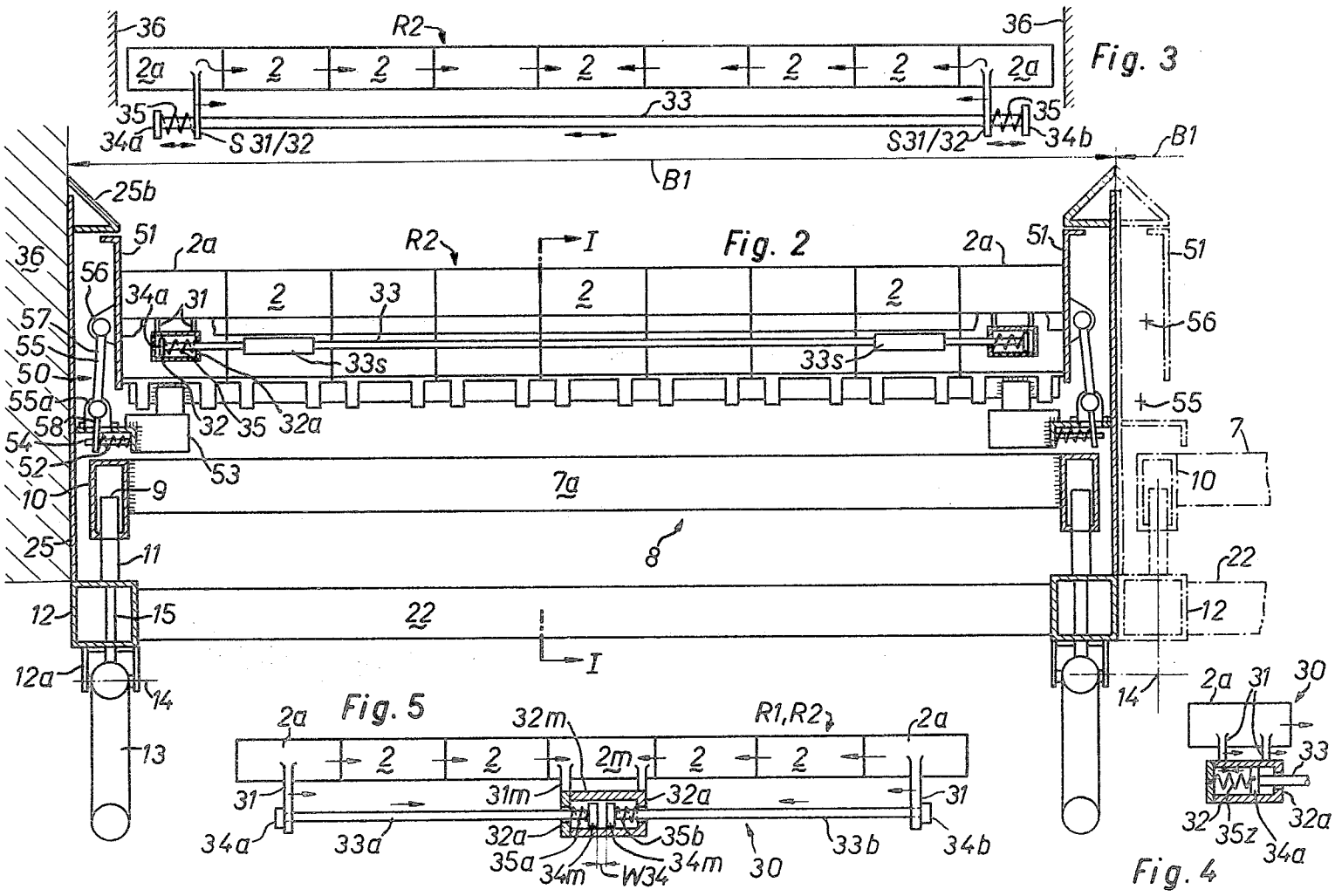
FIG. 2 shows the grate of FIG. 1 and associated parts, in a transverse section taken on the line II-II of FIG. 1.
FIG. 3 shows, diagrammatically, a clamping device of a transverse row of grate blocks of the grate element shown in FIGS. 1 and 2.
FIG. 4 shows a diagrammatic fragmentary view of another version of the clamping device.
FIG. 5 shows a diagrammatic view of a further version of the clamping device.

The grate 1, which has a width B1, is followed transversely to the grate 1 by a second grate which is constructed in exactly the same way as the grate 1 and therefore is only indicated in FIG. 2 by dot-dash lines.

A clamping device 30 is arranged below each row of grate blocks 2, is connected to the two outermost grate blocks 2*a* of the row (see FIG. 2), and is used for pressing all the grate blocks 2 together elastically, so that no gaps are left therebetween, by way of the two outermost blocks 2*a* which themselves are pressed close against the grate blocks 2 which are adjacent to them. A clamping shoe 31 is arranged in the lower part of each of the two external blocks 2*a* and is provided with a spring barrel 32 which is arranged securely on the clamping shoe 31 (see FIGS. 6 and 7). A horizontally arranged multi-part clamping bar 33 is held in the two spring barrels 32 and is provided at its two ends with abutments 34*a* and 34*b* respectively for receiving the clamping pressure. Furthermore, there is arranged in each of the two spring barrels 32 a helical clamping spring 35 which acts as a compression spring. The two clamping springs 35 are disposed about the clamping bar 33 and bear on the one hand on a respective bar abutment 34*a* and 34*b* and on the other hand against a spring barrel end 32*a* of the associated spring barrel 32. The two bar abutments 34*a* and 34*b* form stationary stops for the compression springs 35, whereas the two spring barrel ends 32*a* form spring stops, the two spring barrels 32 being capable of axial displacement relative to the clamping bar 33 each to a predetermined extent - see spacing W 32 in FIG. 7 whereby the wear between the grate blocks can be allowed for. When the grate blocks 2, 2*a* expand as a result of heat, the spacing W 32 increases. Since the clamping bar 33 with its two abutments 34*a* and 34*b* forms a rigid unit and the two clamping springs 35 are in each case elastically compressed between the associated bar abutment 34*a* or 34*b* and the spring barrel end 32*a*, the two clamping springs 35, which tend to expand, apply pressure to the respective spring barrels 32 on the physical principle of action and reaction, and thus at the same time the associated clamping shoes 31, and thus the associated outermost grate block 2*a*, inwards towards the middle of the grate. As a result, all the grate blocks of the mobile transverse row R2 shown in FIG. 2, that is to say an outermost block 2*a*, seven intermediate grate blocks 2 and the other outermost block 2*a*, are pressed elastically against one another so that no gaps remain between any adjacent pairs of grate blocks 2, 2*a*. In exactly the same way as occurs at the mobile transverse rows R2, the grate blocks 2, 2*a* of the stationary transverse block rows R1 are also clamped together by a clamping device 30 in each case. Turnbuckles 33*s* are arranged in the multi-part bar 33 and are used for adapting the length of the clamping bar 33 to the axial spacing of the two spring barrels 32 from one another and/or for adjusting the compressive preload of the two clamping springs 35.

FIG. 3 shows the clamping device 30 of FIG. 2 in a more diagrammatic manner. The two clamping shoes 31 arranged at the outermost blocks 2*a* on the right and left, and also their spring barrels 32 are only shown symbolically, and are designated as S31/32. FIG. 3 also shows that each structure S31/32 is disposed in the transverse direction of the grate, and is connected with the associated block 2*a* in such a manner as to be axially non-displaceable relatively to the block 2*a* in the direction of the clamping bar 33. FIG. 3 shows more clearly than FIG. 2 that all of the grate blocks 2, 2*a* of the transverse row R2 are pressed elastically against one another by the two compression springs 35 through the agency of the clamping bar 33, which is thus subjected to tensile load, statically independently of the combustion chamber side walls 36, in a closed system of forces in the members 33, 34*a*, 35, S31/32, 2*a*, 2, 2*a*, S31/32, 35, 34*b*, 33, and are thus clamped together as is illustrated by arrows in FIG. 3. Instead of arranging a clamping spring 35 at each of the two bar abutments 34*a*, 34*b*, they could be omitted at one of the abutments so that this bar abutment could abut directly on the associated structure S31/32, in which case there would also be no need for this structure to include a spring barrel. In this case all the grate blocks 2, 2*a* of the transverse row R2 would be clamped together elastically only by a single clamping spring 35, that is to say only by the spring arranged at the left or right abutment 34*a* or 34*b*, as the case may be.

FIG. 4 shows another version of the block clamping device 30, and in this case the clamping spring, shown here as 35*z*, is not constructed as a compression spring as in the device of FIGS. 2 and 3, but as a tension spring. The tension spring 35*z*, inserted with preload in the spring barrel 32, is secured on the one hand on the barrel end 32*a* and on the other hand on the abutment 34*a* of the clamping rod 33. Consequently, the tension spring 35*z* draws the spring barrel 32 and the clamping shoe 31, and thus at the same time the leftwardmost block 2*a*, in the direction towards the middle of the grate, contracting and drawing the spring barrel end 32*a* towards the bar abutment 34*a*, as indicated by the arrow in FIG. 4. In FIG. 4 only the left end portion of the clamping bar 33 with the abutment 34*a* and the associated left-hand block 2*a* are shown; correspondingly there can also be arranged at the other, right-hand bar abutment a clamping spring 35*z* constructed as a tension spring, disposed in a spring barrel 32 which is arranged by means of a clamping shoe 31 on the rightwardmost block 2*a*.

FIG. 5 shows a further modified version of the clamping device 30, wherein by means of two aligned clamping bars 33*a* and 33*b*, which are each provided at their ends with respective abutments 34*a*, 34*m* and 34*b*, 34*m*, under the action of respective clamping springs 35*a* and 35*b*, and through the agency of the two outermost blocks 2*a*, all the grate blocks of each transverse row R1 or R2 are pressed elastically against one another. The two clamping bars 33*a*, 33*b* are held indirectly at the blocks 2*a* and a common central grate block 2*m* by means of clamping shoes 31 and 31*m* arranged in these three blocks. Whereas downwardly projecting arms of the clamping shoes 31 arranged in the external blocks 2*a* abut on the outer abutments 34*a* and 34*b* respectively of the clamping bars 33*a* and 33*b*, the clamping shoe 31*m* of the central block 2*m* is provided with a spring barrel 32*m* which is common to the two clamping bars 33*a*, 33*b* and in which the two clamping springs 35*a*, 35*b*, which are compression springs, are arranged and disposed about the clamping bars 33*a* and 33*b* respectively between the ends of the spring barrel 32*m* and the two inner abutments 34*m*. Each of the two outermost blocks 2*a* is capable of being displaced axially in the direction towards the central block 2*m* together with the associated clamping bar 33*a* or 33*b* by means of the abutment 34*a*, 34*b* respectively thereof, the two blocks 2*a* pressing elastically the central block 2*m* of the transverse row R1 or R2 via the grate blocks 2 situated between the outermost blocks 2*a* and the central block 2*m* and under the action of the associated compression springs 35*a*, 35*b* respectively in two closed systems of forces which are statically independent of one another and of the combustion chamber side walls 36, that is to say the system 33*a*, 34*a*, 31, 2*a*, 2, 2*m*, 31*m*, 32*m*, 35*a*, 34*m*, 33*a*, and the system 33*b*, 34*b*, 31, 2*a*, 2, 2*m*, 31*m*, 32*m*, 35*b*, 34*m*, 33*b*. As a result, all of the grate blocks 2, 2*a*, 2*m* of this transverse row are clamped together. The abutments 34*m* are spaced from one another at a distance W34.

Figure 6:
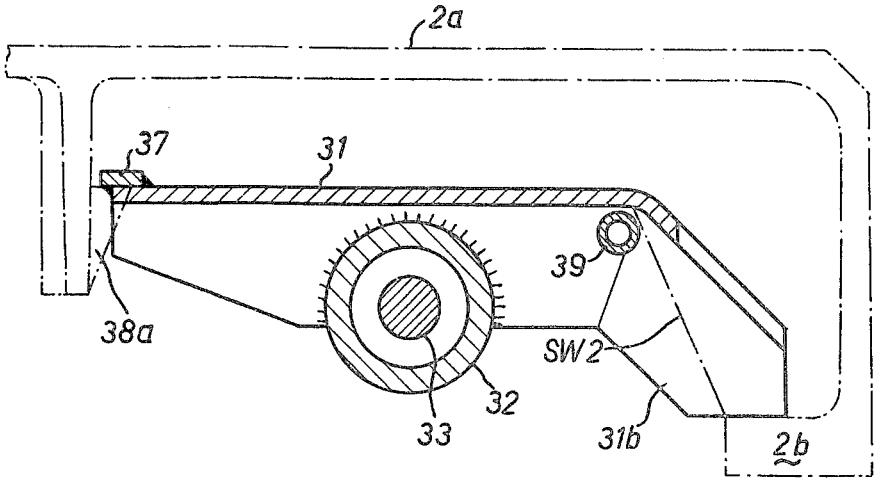
FIG. 6 shows a clamping shoe of the clamping device of FIGS. 2 and 3, in a cross-section taken on the line VI—VI of FIG. 7.

FIG. 6 shows how the clamping shoe 31 according to FIG. 2 having the weld-connected spring barrel 32 is received in an outermost grate block 2*a*, which is only shown here with dot-dash lines. At the left, viewing FIG. 6, the clamping shoe 31 lies, by means of a support strip 37 arranged thereon, on two ribs 38*a* of the block 2*a*, whilst at the right it is inserted between two ribs 38*b* of the block 2*a* and is placed by means of obliquely downwardly directed shoe portions 31*b* on an internal surface of a wearing limb 2*b* of the block 2*a* (see also FIG. 7).

Figure 7:
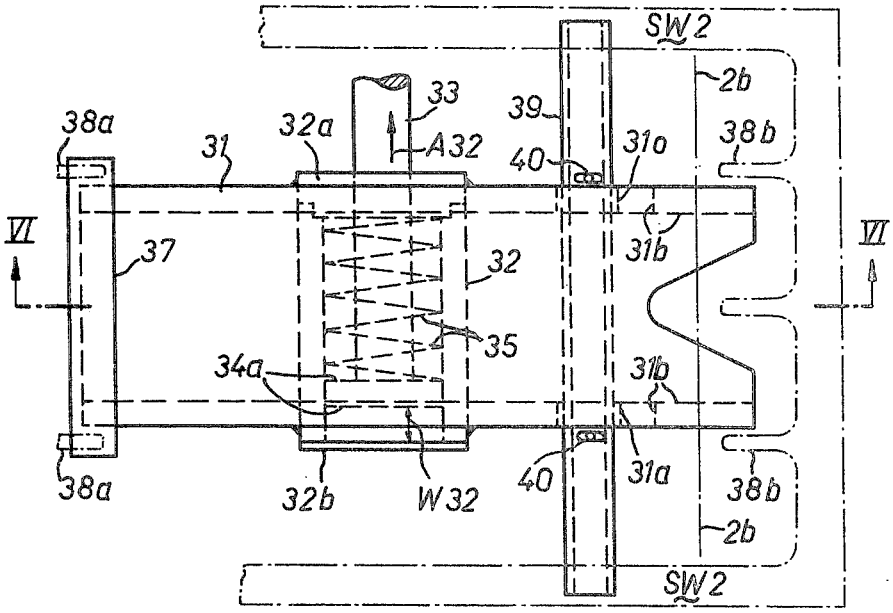
FIG. 7 shows the clamping shoe of FIG. 6 in plan view.

FIG. 7 shows that the two pairs of ribs 38*a* and 38*b* of the block 2*a* are used for securing the clamping shoe 31 in and relatively to the grate block 2*a* in the direction of the clamping bar 33, so that the compression spring 35 can displace the clamping shoe 31 together with the block 2*a* axially only of the clamping bar 33. The clamping shoe 31 is provided with a through aperture 31*o* in each of its two lateral cheeks, and through these aperturea a horizontal securing tube 39, parallel to the clamping bar 33, extends and is secured by two securing split pins 40 against any axial displacement relatively to the clamping shoe 31. The securing tube 39, which abuts on the two side cheeks SW2 of the block 2*a* (see FIG. 6) is used for securing the clamping shoe 31, in a direction at right angles to the clamping bar 33, relative to the external block 2*a*. The clamping shoe 31, and the block 2*a*, is capable of being displaced by the expanding compression spring 35 over the predetermined distance W32 between a cover 32*b* and the bar abutment 34*a* in the direction of the arrow A32.

FIG. 2 also shows a sealing device which operates independently of the clamping device 30 and is given the general reference numeral 50. Lateral sealing elements in the form of sealing plates 51 provided at the two lateral edges of the grate 1 can be displaced substantially parallel to themselves by, in each case, at least one compression spring 52, which is disposed about a pivot 54 mounted on a stationary supporting structure 53 of the grate 1 through the agency of a two-arm lever 55 pivotally mounted by means of a pivot 55*a* on the stationary supporting structure 53, and thus urged resiliently into sealing contact against the outer side surface of the outermost blocks 2*a* of the transverse block rows R1 and R2. An upper arm 57 of the lever 55 is pivotably connected, by means of a pivot pin 56, to the sealing plate 51, whilst a lower lever arm 58 of the lever 55 is loaded by the pressure of the sealing spring 52.

The compression springs 52 of the sealing device 50 can be considerably weaker than the compression springs 35 of the block clamping device 30, since they have only to produce the relatively small effective sealing pressure at the sealing plates 51. The sealing device 50 is situated, protected from dust and heat, between the lateral longitudinal deep beam 25 and the sealing plate 51, and a roof element 25*b* closes off the upper end of the space between the beam 25 and the place 51, leaving only a narrow gap.

Not only the outermost blocks 2*a* of the mobile transverse block rows R2, but also those of the stationary transverse block rows R1 are sealed at their outer side edges by the spring-loaded lateral sealing plates 51. For independently of whether the blocks 2*a* are mobile or stationary, the combustion air could otherwise flow past the outer sides of the outermost blocks 2*a* and into the combustion chamber, which would be fundamentally undesirable.

The plate division selected for the sealing plates 51 arranged in succession to one another in the feed direction A (see FIG. 1) of the grate 1 derives from the row division of the stationary and mobile transverse block rows R1 and R2 following one another in the feed direction A. The length of the sealing plates 51 could in fact be made so considerable that each plate 51 is pressed elastically against the side surfaces of a plurality of successive outermost blocks 2*a*, but for this purpose all the block side surfaces associated with the plate would have to be situated precisely in alignement in a common vertical plane so that the plate 51 effectively contacts all of these block side surfaces with the necessary sealing pressure, although in practice this happens only very seldom even if only because of the fact that the positions or displacement travels of the blocks 2*a* differ from row to row. The sealing plates 51 may also extend in the direction of movement of the mobile grate blocks; the stationary outermost blocks 2*a* of the stationary transverse rows R1 in that case are sealed with special plates which are also arranged in the inclined grate block position.

Instead of the constructional example of the mechanical feed grate explained hereinbefore with reference to the drawings, the block clamping and sealing devices of the grate can also be used in combustion grates having exclusively mobile transverse block rows following one another in the feed direction. If a clamping spring barrel 32 is provided only at one of the two outermost blocks 2*a*, and the other outermost block is axially supported without any clamping spring 35 with a "hard" abutment directly against the associated clamping bar abutment 34*a* or 34*b*, the compression spring which is then the only clamping spring must be able to carry out a larger effective clamping travel corresponding to the larger number of grate gaps for which it has to compensate, and in that case it should also be made stronger in accordance with the now greater total mass of the grate blocks which have to be displaced by the said spring in the direction towards the other bar abutment. Instead of a helically wound clamping spring constructed as a compression spring, it is also possible to use, at the relevant bar abutments, in each case a set of cup springs arranged in succession to one another, in which case the clamping pressure or clamping travel can be modified by the number of and/or the fitting position of the springs (cup bases on one another or against one another).

In the feed grate apparatus discussed hereinbefore with reference to the drawings, the close pressing against one another of the grate blocks situated adjacent one another in transverse block rows is effected functionally and mechanically quite independently of the necessary sealing of the two outermost blocks of each transverse row relatively to the adjoining combustion chamber side walls. This has the important advantage that the sealing pressure required for sealing the grate elements at both sides, which can already differ considerably in accordance with its function from the block clamping pressure in the transverse block rows, that is to say may be usually considerably smaller than this pressure, can now be selected quite independently of the block clamping pressure. As a result it is possible to have a much smaller application pressure for the lateral sealing plates and thus a correspondingly smaller mechanical wear both at the plates themselves and also at the lateral sealing surfaces of the outermost blocks bearing against the said plates. Furthermore, the block clamping device is not subjected directly to the heat from the combustion chamber or fuel bed, and it is at the same time protected from dust and ash from the fuel layer situated on the grate, since it is arranged below the grate blocks and as a result is well shielded thermally and mechanically from the combustion chamber and also from the layer of fuel. Similar remarks apply also as regards the lateral grate sealing arrangement since its mechanism also is arranged - protected from direct firing system heat, fuel dust and ash - between a lateral longitudinal beam of the stationary supporting structure of the grate and the sealing plate. Also, owing to the clamping together of the grate blocks, undesirable falling of material through the grate is substantially prevented. Furthermore, the block clamping and sealing devices are integrated in the grate, which consists of a predetermined number of successive transverse block rows, so that the grate can be simply placed, together with its clamping and sealing devices, on the furnace framework or lifted away therefrom, that is to say can easily be fitted and dismounted, and therefore can be assembled in the workshop to constitute a complete grate unit constructionally and functionally. Because of the excellent side sealing arrangement, not only are there no undesirable so-called "marginal fires", but also it is ensured that there is a predetermined uniform, controllable guidance of combustion air within the fuel layer because of the fact that the combustion air can enter the fuel layer from below only by way of the openings already provided for this purpose in the grate blocks at the time they are cast, these openings being used at the same time for cooling the grate blocks, (in the drawings these have not been shown, in order to leave the drawings clearer to read), since an undesirable passage of air through gaps between the grate blocks is effectively prevented. The window-like openings in the grate blocks for the passage of the combustion air are relatively small, that is to say the pressure drop in the air which they cause is relatively considerable, and this has the advantage that the following pressure drop within the fuel layer is relatively small, so that the flow of combustion air in the fuel bed is made uniform and controllable, under the influence of the uniform grate and not the non-uniform layer of refuse on the grate. A further advantage of the feed grate apparatus described hereinbefore is that it can be constructed on the unit construction principle by simple flange connection of the grates to one another in the feed direction as regards length and transversely to the grate apparatus as regards width; the individual grate can be given for example a length of 2*m* and a width of 1.8*m* or 2*m*. The grate can be inclined in any desired manner and the grate blocks are forcibly cooled in an advantageous manner by the combustion air flowing upwards through them from below, since the air cannot escape through gaps between adjacent grate blocks into the combustion chamber.

We claim:

1. In combination, a furnace grate comprising transverse rows of grate elements whereof the elements of each row are arranged side-by-side with one another; clamping means associated with each of said rows and arranged to urge elements of the row towards one another to press their sides into contact with one another; sealing means at the ends of the rows for sealing against said ends of the rows; and biassing means arranged to urge said sealing means into sealing contact with said ends of the rows with urging force independent of the clamping force provided by said clamping means.

2. A combination according to claim 1, wherein said clamping means is disposed at the undersides of said rows.

3. A combination according to claim 1, wherein said clamping means comprises anchoring means of one of the outermost grate elements of each of said rows, anchoring means of another of the grate elements of that row, and resilient means arranged to act between the two anchoring means to urge said one of the outermost grate elements towards said other of the grate elements.

4. A combination according to claim 3, wherein said other of the grate elements is the other of the outermost grate elements of the row.

5. A combination according to claim 3, wherein said clamping means further comprises, for each row a clamping bar via which the force provided by said resilient means is transmitted from said resilient means to one of said two anchoring means.

6. A combination according to claim 5, wherein, for each row, the clamping bar comprises, at first and second end zones thereof respectively, first and second abutment means, and said resilient means is arranged between said first abutment means and the other of said two anchoring means.

7. A combination according to claim 6, wherein, for each row, said clamping means further comprises another resilient means arranged between said second abutment means and said one of the anchoring means.

8. A combination according to claim 7, wherein each of the resilient means is a spring, the springs being of substantially identical construction to one another.

9. A combination according to claim 5, wherein, for each row, said other of the grate elements is an intermediate grate element, and the clamping means further comprises anchoring means of the other of the outermost grate elements of the row, another resilient means arranged to act between the anchoring means of the other of the outermost grate elements and the anchoring means of the intermediate grate elements, and another clamping bar via which the force provided by said other resilient means is transmitted from said other resilient means to one of said anchoring means of the other of the outermost grate elements and said anchoring means of said intermediate grate element.

10. A combination according to claim 5, wherein each anchoring means comprises a shoe received in the associated grate element and secured against movement relative thereto in a direction transverse of the grate.

11. A combination according to claim 10, wherein, for each row, the resilient means comprises a spring, one of the shoes comprises a spring barrel receiving said spring and having abutment means, the clamping bar extends within said spring barrel and comprises abutment means, and the spring is arranged between the abutment means of said spring barrel and the abutment means of said clamping bar.

12. A combination according to claim 9, wherein, for each row, the anchoring means of the intermediate grate element is in the form of a shoe received in the intermediate grate element and secured against movement relative thereto in a direction transverse of the grate, each of the resilient means is a spring, the shoe comprises a spring barrel receiving the springs and having first and second abutment means, the clamping bars extend into said spring barrel, each clamping bar comprises abutment means, and each of the springs is arranged between a respective abutment means of said spring barrel and the abutment means of the associated clamping bar.

13. A combination according to claim 12, wherein the springs are of substantially identical construction to one another.

14. A combination according to claim 1, wherein the grate elements of alternate rows thereof are movable bodily in a predetermined direction in order to feed material along said grate, whereas the grate elements of the remaining rows thereof are substantially immovable in said direction.

15. A combination according to claim 14, wherein all of the grate elements are of substantially identical construction to one another.

16. A combination according to claim 14, wherein the clamping means associated with said alternate rows of grate elements are of substantially identical construction to the clamping means associated with said remaining rows.

17. A combination according to claim 14, wherein, at each lateral edge of the grate, said sealing means comprises individual sealing elements associated with the respective rows of grate elements, and the sealing elements associated with said alternate rows extend in said predetermined direction.

18. A combination according to claim 1, wherein said grate, said clamping means, said sealing means and said biassing means can, when installed in a furnace, be removed as a single unit therefrom and re-installed as a single unit therein.

19. A combination according to claim 1, and further comprising static frame means, and wherein said biassing means comprises spring means mounted on said frame means, and lever means pivotally mounted on said frame means and via which said spring means urges said sealing means into sealing contact with said ends of said rows.

20. A combination according to claim 1, and further comprising a second furnace grate comprising transverse rows of grate elements whereof the elements of each row are arranged side-by-side with one another; clamping means associated with each of the rows of grate elements of said second grate and arranged to urge the elements of the row towards one another to press their sides into contact with one another; sealing means at the ends of the rows of the second grate for sealing against these ends; and biassing means arranged to urge the latter sealing means into sealing contact with these ends with urging force independent of the clamping force provided by the latter clamping means; the second grate being located one of side-by-side and end-to-end with the first-mentioned grate.

* * * * *